United States Patent [19]

Bleickert

[11] Patent Number: 4,589,634

[45] Date of Patent: May 20, 1986

[54] FURNACE FOR SMELTING NON-FERROUS AND/OR FOR HOLDING NON-FERROUS METAL MELTS

[76] Inventor: Gerhard Bleickert, Raiserstrasse 3, D6920 Sinsheim-Weiler, Fed. Rep. of Germany

[21] Appl. No.: 476,073

[22] Filed: Mar. 17, 1983

[51] Int. Cl.[4] ..... F27D 11/02

[52] U.S. Cl. ..... 266/215; 266/236; 266/900; 373/128

[58] Field of Search ..... 373/128; 75/68 R, 65 R; 266/901, 900, 215, 200, 236

[56] References Cited

U.S. PATENT DOCUMENTS

| | | | |
|---|---|---|---|
| 3,783,169 | 1/1974 | Newhall | 266/215 |
| 3,996,412 | 12/1976 | Schaefer et al. | 75/68 R |
| 4,460,163 | 7/1984 | Hornung | 266/236 |

*Primary Examiner*—Melvyn J. Andrews
*Attorney, Agent, or Firm*—Jones, Tullar & Cooper

[57] ABSTRACT

A furnace for smelting nonferrous metals and/or for holding nonferrous metal melts is proposed which has a multiple-chamber trough having at least one filling chamber, at least one smelting chamber and/or one holding chamber and at least one drain chamber, and at least one lid for covering the smelting chamber and/or the holding chamber. The filling chamber communicates with the smelting or holding chamber through a passage and the smelting or holding chamber communicate with the drain chamber through another passage. All passages are located beneath the surface of the metal melt introduced into the furnace. The furnace also has a tapping-off device including a stationary molded piece located at the bottom of the drain chamber where it defines an outflow opening, and a tubular tap plug which is rotatably mounted to the stationary molded piece at one end and extends outwardly from the furnace with its other end. The tubular tap plug is rotatable to communicate with the outflow opening to provide a passage from the drain chamber out of the furnace.

7 Claims, 5 Drawing Figures

FURNACE FOR SMELTING NON-FERROUS AND/OR FOR HOLDING NON-FERROUS METAL MELTS

BACKGROUND OF THE INVENTION

The present invention relates to a furnace for smelting non-ferrous metals and/or for holding non-ferrous metal melts. The furnace has a trough and a lid. The lid covers at least a portion of the trough and is provided on its inside with devices for transmitting heat directly to the metal melt introduced into the trough.

In known furnaces of this kind, the lid having the devices for heat transmission (heating devices) extends over only a portion of the trough. A bulkhead extending vertically from above into the trough is attached to the lid along one edge thereof, so that the portion of the trough outside the lid is divided from the portion of the trough inside the lid, begining at the lid itself, as far as a certain depth into the introduced metal melt. In this apparatus, it is not possible to put the lid on when the melt has cooled partially, because in that case the bulkhead is no longer capable of dipping into the metal melt. Such a situation may arise if there has been damage to the heating device or to some other part of the lid, the repair of which lasts at least long enough that the surface of the metal melt is already begining to cool. For this reason, in the known holding furnace, a substitute lid must always be ready at hand. Furthermore, this bulkhead is not optional because backward flows of the metal melt out of the smelting and holding chambers back toward the filling location are possible at least when the lid is open. That means that an optimally calmed (degassed) and thus purified material does not reach the drain location. This has a negative effect on the quality of the injection molded die-cast part made from the material.

OBJECT AND SUMMARY OF THE INVENTION

It is an object of the present invention to provide a furnace of the general type discussed above in which the lid can also be put back on and the holding furnace can be put back into operation even if the lid itself has to be removed, for instance as a result of some interuption, for such a long time that at least the surface of the metal melt has begun to cool.

Another object of the present invention is to assure that the holding process requires as little energy as possible. Thus the invention is to attain substantial saving in energy as compared with such conventional holder furnaces, and in which heating devices are disposed not in the lid but instead such that they surround the trough into which the metal melt is introduced.

Another object of the present invention is to prevent the dross which forms on the surface in the filling region from passing on to the holding region and the drain region.

In a smelting and/or holding furnace for non-ferrous metals or non-ferrous metal melts of the type described generally above, this object is attained by a furnace embodied as a multiple-chamber trough and a lid which covers the smelting chamber and/or the holding chamber. In addition, the filling chamber communicates with the smelting chamber or the holding chamber which in turn communicates with the drain chamber via passages located beneath the surface of the melt.

Thus the three or four regions, that is, the filling region, smelting region and/or holding region and drain region are realized by means of separate chambers. Movement of material from the filling chamber to the smelting or holding chamber and from that chamber into the drain chamber is possible, but it occurs only beneath the surface of the metal melt, so that the dross formed during pouring is restrained at the partioning plate between the filling chamber and the holding chamber. At the same time, the advantages of heating by means of direct radiation of heat to the surface of the metal melt by means of heating devices in the lid are fully realized. The skimming region or skimming chamber needs to have no more than relatively small dimensions in order to be able to supply a machine (for instance, a dicasting machine), from it. The same applies to such furnaces where a smelting chamber and a holding chamber are provided, so that two chambers separate from one another are provided, specifically one for smelting and a following chamber for holding. It is thereby possible to calm the flow of the nonferrous metal melt over two stages, so that material which has been optimally degassed or calmed is available in the holding chamber or in the drain chamber following it and embodied as a pouring or skimming chamber; such material, after being processed in a di-casting machine, for instance, produces quite staisfactory di-cast or injection molded parts.

In a furnace with a passage between the smelting chamber and the holding chamber which extends over only a portion of the width or length of the chamber, even the relatively small passage opening from the smelting chamber to the holding chamber contributes to the calming of the metal melt.

If in a smelting and holding furnace the interior region of the trough from the filling opening as far as the drain opening extends in a substantially straight line, then in accordance with a further exemplary embodiment of the present invention it is efficasious to dispose the passage from the smelting chamber to the holding chamber in a lateral region of an intermediate wall dividing the two chambers, preferably directly adjoining the side wall of the trough. This has a substantial advantage that the fluid or solid material introduced into the filling opening is prevented from passing immediately all the way through the smelting chamber into the holding chamber. Furthermore, when the metal melt is drained out, a calm, laminar flow from the smelting chamber to the holding chamber is brought about which contributes substantially to the provision for calming.

In accordance with a further exemplary embodiment of the present invention, the furnace is provided with a tapping-off device for the non-ferrous metal melt.

In a known tapping-off device, a plug is provided which is mechanically movable via a lever linkage; the plug is pressable onto the outlet opening in the end wall of the furance in a sealing manner. This plug has to be pressed with substantial pressure into the outlet opening so that sealing is possible. Then when the plug is open, if it is moved away from the outlet opening to slowly, the danger exists that the fluid metal will spray out at several locations on the circumference of the outlet opening past the plug, rather than flowing out at the lower rim of the outlet opening in a clearly defined manner. The same is true for the case where the plug is moved too slowly in the closing direction. This is a substantial disadvantage because not only is material wasted but the operator of the apparatus is put in danger. In the known tapping-off device, the plug is made of graphite or a special steel, and such materials are capable of withstanding the aggressive behavior of the non-ferrous metal melts, especially aluminum melts, for only a relatively short time.

In order to provide a tapping-off device for a smelting and/or holding furnace for non-ferrous metals or non-ferrous metal melts of this general type, but which is simplier and more reliable in operation and furthermore has a long service life. The furnace is provided with a movable closure element capable of closing the outlet opening of the drain chamber such that at the bottom region of the drain chamber a molded piece of durable material is inserted such that it is stationary, the molded piece being provided with an outflow opening, and a tubular part, in the form of a tap plug, is provided which is insertable into the stationary molded piece and held rotatably therein.

The tapping-off device is thus embodied in the manner of water faucets, that is, it has a tap plug which is rotatable inside a stationary molded piece inserted into the tank insulation in such a manner that its outlet opening, in a predetermined rotational range, communicates with the drain opening in the molded piece and in another rotational range is remote therefrom, thus blocking the outflow of the metal melt. Preferably both the stationary molded piece and the tubular tap plug are fabricated from a durable ceramic material which withstands the aggressive non-ferrous metal melts, in particular aluminum melt. The blocking region is shifted inward so that untentional spraying during opening and/or closing is prevented.

Further details and embodiments of the present invention may be learned from the following description, in which the invention is described and explained in detail in terms of the exemplary embodiment shown in the drawing.

DESCRIPTION OF THE PREFERRED EMBODIMENT

Figure 1:
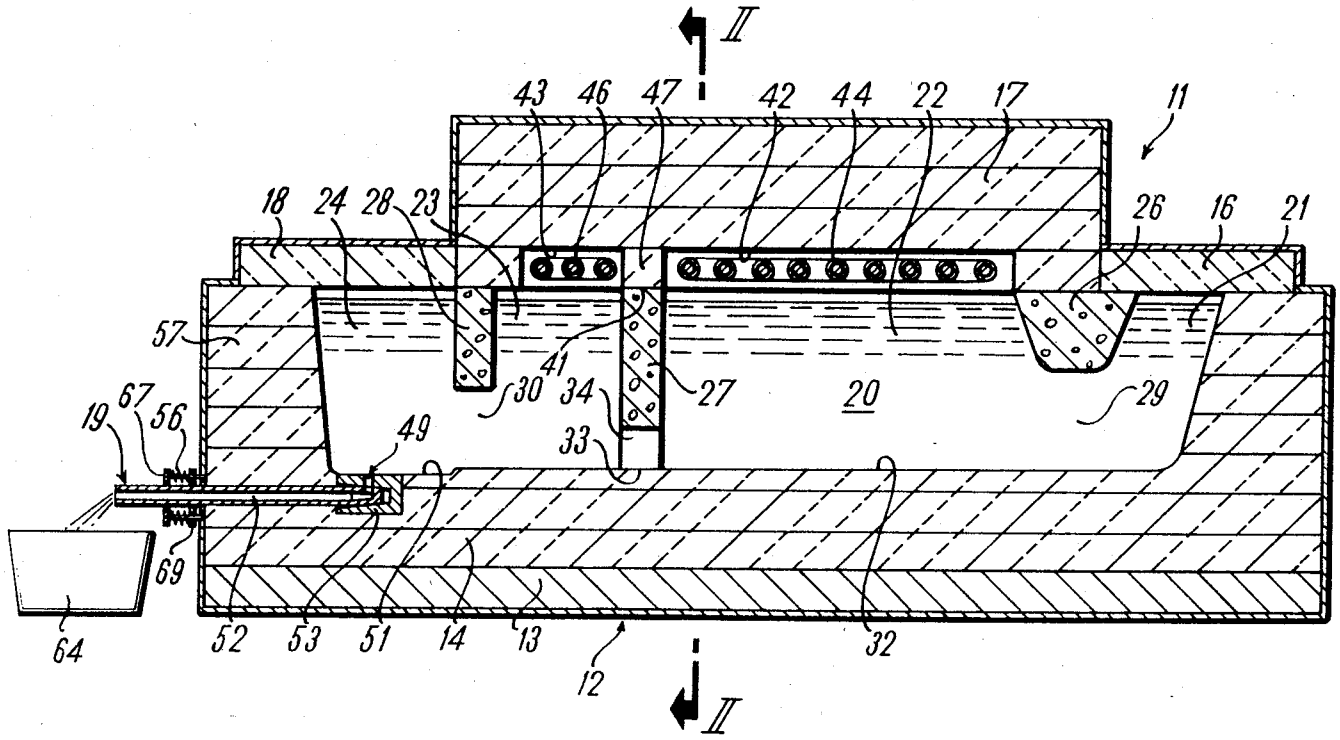
FIG. 1, schematically shows a longitudinal section taken through a smelting and holding furnace having a tapping-off device in accordance with a preferred exemplary emodiment of the present invention.
Figure 2:
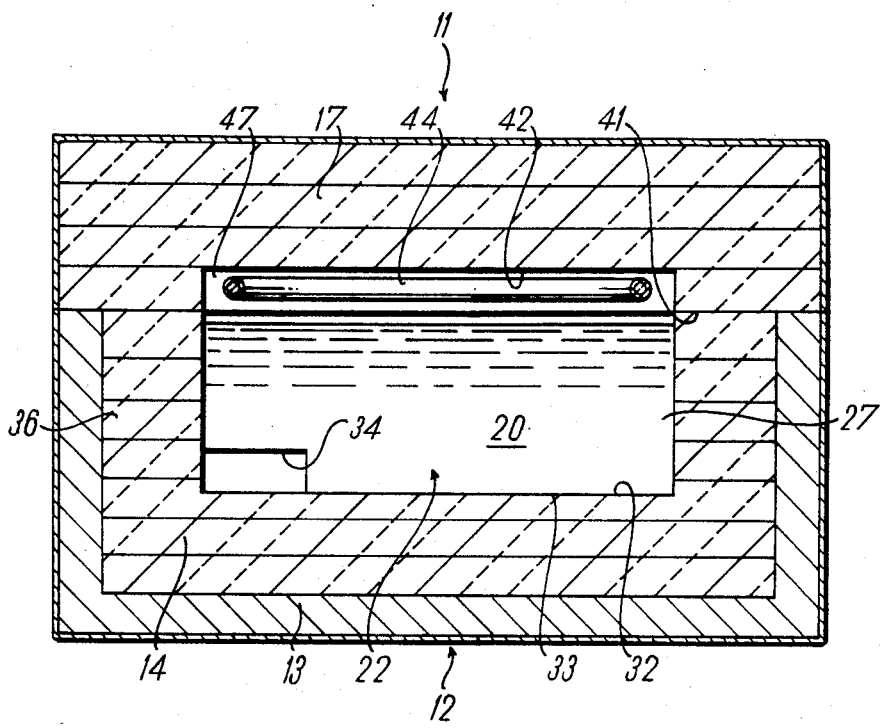
FIG. 2, is a section taken along the line II—II of FIG. 1.
Figure 3:
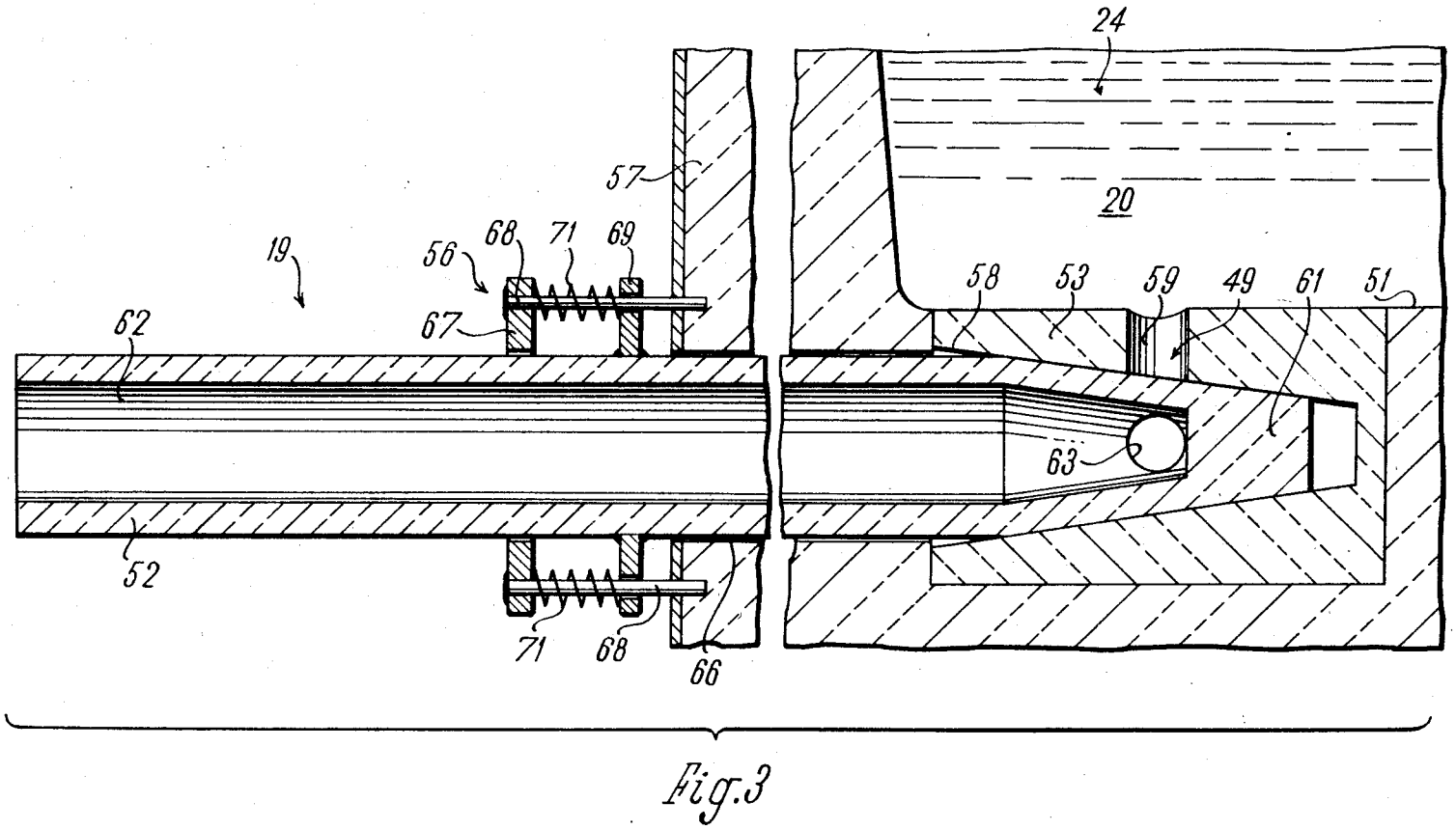
FIG. 3, is an enlarge and partially cut away illustration of the tapping-off device of FIG. 1.

A smelting and holding furnace 11 according to a preferred exemplary embodiment of the present invention shown in FIGS. 1-3 is embodied as a multiple-chamber furnace and serves both for smelting and for holding non-ferrous metals or non-ferrous metal melts. Because of the multiple-chamber system, a satisfactorily degassed or calmed material (non-ferrous metal melt) is available at the draining location of the furnace.

The smelting and holding furnace 11 substantially comprises a foundation 12 in the form of a sheet-metal housing reinforced with an elongated retangular frame 13, a trough 14 of heat-insulating material in the form of high-grade monolithic lining material formed inside the housing, a plurality of lids 16, 17, and 18 and a tapping-off device 19.

The trough 14 has a conventional, elongated, retangular basic shape and is likewise approximately retangular in cross section. It is subdivided into a plurality of chambers which, in the exemplary embodiment, are located in a straight line one after the other. The chambers, viewed in the flow direction of the non-ferrous metal melt 20, are in this case as follows: A filling or charging chamber 21, a smelting chamber 22, a holding chamber 23, and a drain chamber 24 embodied as a pouring chamber. These chambers 21 through 24 are divided from one another by barriers or intermediate walls 26, 27, and 28, which are in the form of plates made of refractory concrete. The intermediate wall 26 is approximately trapezoidal and is disposed between the filling chamber 21 and the smelting chamber 22, its wider top terminating at the upper rim of the trough 14 and its narrower bottom 31 being disposed spaced from the bottom 32 of the trough 14 by a distance equal to approximately half the depth of the metal melt bath 20. As a result, a passage extending over the trough width is provided in the bottom region of the trough 14 between these two chambers 21 and 22. The intermediate wall 27 disposed between the smelting chamber 22 and the holding chamber 23 is a plate the cross section of which corresponds to the cross section of the trough 14, which likewise is in alignment at its top with the upper rim of the trough 14 but with its bottom 33 is seated on the bottom 32 of the trough 14. In the vicinity of the bottom, this intermediate wall 27 is provided with a passage 34 of retangular shape, by way of example, which as FIG. 2 shows is disposed directly adjacent a side region of the trough bottom 32 and the trough side wall 36. It will be understood that this passage 34 may equally well be disposed on the other side of the intermediate wall 27 instead. In proportion to the cross section of the trough 14 or the area of the intermediate wall 27, the passage 34 has a relatively small cross section, which is preferably approximately 25 to 30 times as small an area as the area of the intermediate wall 27. The intermediate wall 28 between the holding chamber 23 and the pouring chamber 24 is embodied as a rectangular panel of elongated cross section, which is disposed such that its top is in alignment with the top rim of the trough 14 and its bottom 37 dips into the metal melt 20 in such a manner that it is located opposite the trough bottom 32 at a distance from it which is somewhat less than half the depth of the trough 14. As a result, here in the bottom range 32 of the trough 14 as well, a passage 30 extending over the trough width is provided.

Thus the individual chambers 21 through 24 are divided from one another in such a manner that flow interference of the layers of metal melt among the individual chambers is prevented, and in particular the fluid or solid material introduced into the filling or charging chamber 21 is prevented from shooting on through smelting chamber 22 directly into the holding chamber 23 or even into the pouring chamber 24, as might otherwise happen.

The tapping-off device 19 is located at the bottom 51 of the draining or pouring chamber 24 and passes through the monolithic lining material of the end wall 57 to the outside. The tapping-off device 19 has a stationary molded piece 53 which has a drain opening 49 in it, and a molded, tubular element 52 in the form of a tap plug, which is insertable into the stationary molded piece 53 and rotatable therein. Both the stationary molded piece 53 and the tubular tap plug 52 are fabricated from a ceramic material which is both heat resistant and resistant to the aggressive nonferrous metal melts.

The stationary molded piece 53 is inserted and integrally cast in the bottom 51 of the drain chamber 24. As FIG. 3 in particular shows, the drain opening 49 is embodied in the form of a T standing on its head; that is, it has a blind bore 58 extending in the axial or horizontal direction, which is embodied such that it tapers conically from the outside toward the inside, and a radial drain opening 59 is the form of a radial bore, which at one end communicates with the interior of the drain or pouring chamber 24 and at the other end discharges into the blind bore 58 in a region corresponding to approximately half the depth of the blind bore 58 in the molded piece 53.

The tubular tap plug 52, likewise embodied as a molded element, is hollow-cylindrical over virtually its entire length, and on its inner end it has a conical extension 61, in which the drain opening 62 tapers conically and terminates. In the vicinity of this inner end of the drain opening 62, a radial communication opening 63 is provided which communicates at its inner end with the drain opening 62 and exits at the corresponding region of the outer circumference of the conical extension 61. The outer cone of the conical extension 61, in terms of its angle, which for example, may be 8°, corresponds to the angle of the inner cone of the blind bore 58 of the stationary molded piece 53. Thus the tap plug 52 can be inserted in a sealing manner with its conical extension 61 into the conical blind bore 58. The internal diameter ranges are selected such that in the insertion shown in FIG. 3, a space remains open between the end of the conical extension 61 of the tap plug 52 and the bottom of the blind bore 58 in the stationary molded piece 53. Furthermore the dimensional ratios are such that the radial communication 63 of the tap plug 52 is located in the same cross-sectional plane as the radial drain opening 59 in the stationary molded piece 53. As a result it is possible by rotating the tap plug 52 out of the position shown in FIG. 3 (in this case, for instance, by 90° counterclockwise), to align the radial communication opening 63 and the radial drain opening 59 with one another, so that one continuous connection is provided from the interior drain chamber 24 to the outside to a trough 64 or a die-casting machine, directly for draining off or tapping-off a portion of the non-ferrous metal melt.

The tap plug 52 which is held in a recess 66 of the end wall 57, is axially guided on its protruding out of the end wall 57 in an annular plate 67. The annular plate 67 is secured to the end wall 57 of the furnace 11 via two or more stay bolts 68 distributed about the circumference. In a region between the stationary annular plate 67 and the outer face of the end wall 57, the tubular tap plug 52 is provided with a radially off-standing molded collar 69, which is provided with recesses by means of which it is displaceably guided along the stay bolts 68 and in the axial direction of the tap plug 52. Two opposing stay bolts 68, or a plurality of the stay bolts or all the stay bolts are surrounded by a compression spring 71. These compression springs 71 are supported at one end of the annular plate 67 and at the other end on the collar 69. In this manner a pressure acting in the axial direction of the tap plug 52 is produced, which causes the conical extension 61 to be pressed slightly into the conical blind bore 58, so that a sealed bearing is always provided. The compression springs 71 may be relatively weak, because the tap plug 52 exerts virtually no axial counter pressure, and of course the pressure of the non-ferrous metal melt acts substantially only in the radial direction because of the very small angle of inclination of the cone. The recesses in the collar 69 for the passage there through of the stay bolts 68 are embodied as oblong holes of a ciruclar arc form, in order to assure that the tap plug 52 can be rotated about its longitudinal central axis into its position enabling the flow of the non-ferrous metal melt as well as into its position blocking the flow of the metal melt.

Although the tapping-off device 19 is shown in the drawing and described in connection with a smelting and holding furnace, it will be understood that a tapping-off device 19 of this kind can also be used in such furnaces which are intended either only for holding non-ferrous metal melts, such as that described in FIGS. 4 and 5, or only for smelting non-ferrous metal.

The lid 17 covering both the smelting chamber 22 and the holding chamber 23 is likewise made up of a sheet-metal housing and a high-grade, optimally insulating monolithic lining material disposed therein. The lid 17 is capable of being raised by means of hydraulic assemblies, not shown, such that it is pivotable upward being articulated on one side, or in other words is pivotable upward from the opposite side. On its underside 41 the lid 17 has two elongated rectangular recesses 42 and 43, in each of which a plurality of heating elements 44 or 46 is disposed, extending parallel to one another and connected with one another either individually or in groups; the heating elements 44 and 46 comprise electrical heating rods embedded in the material making up the element. The heating elements 44, 46 are disposed directly above the rim of the trough 14 and thus directly above the surface of the metal melt bath 20. The varying number of heating elements 44 is intended for the smelting chamber 22 and the other group of heating elements 46 is intended for the holding chamber 23. Based on the adjacently disposed recesses 42, 43, a transversely extending panel 47 disposed between them is formed, which when the lid 17 is closed rests on the top of the intermediate wall 27, thus preventing thermal influence on the part of heating elements 44 and 46 among themselves. The two other lids 16 and 18, which are substantially smaller and are likewise rectangular in embodiment, are designed such that they can be removed by hand, for instance.

Figure 4:
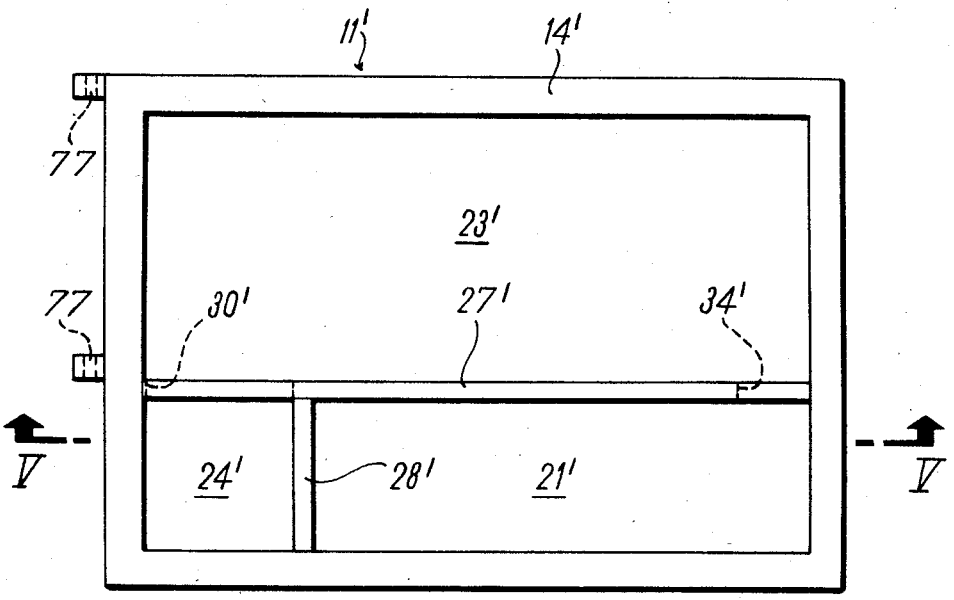
FIG. 4, is a schematic plan view of a holding furnace with its lids removed, in accordance with another exemplary embodiment of the present invention.
Figure 5:
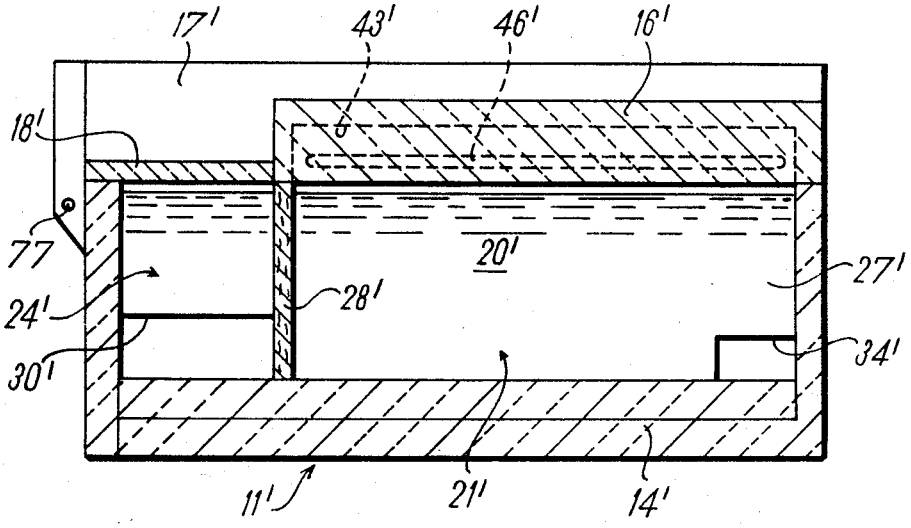
FIG. 5, is a section taken along the line V—V of FIG. 4.

,The furnace 11' shown in FIGS. 4 and 5, which serves only to keep non-ferrous metal melts 20' warm, is likewise embodied as a multiple-chamber furnace, but one in which the individual chambers are located not in a straight line one after another but are instead disposed in an approximate U-shape, beside one another. One multiple-chamber trough 14' is subdivided with the aid of a plate 27' and a plate 28', each made of ceramic fibers, by way of example, into a filling chamber 21', a holding chamber 23' and a drain chamber 24', a holding chamber 23' and a drain chamber 24' embodied as a skimming chamber. This subdivision is shown schematically in FIG. 4. The plate 27' is embodied such that in the bottom region a relatively small opening 34' is formed between the filling chamber 21' and the holding chamber 23', as is an opening 30' between the holding chamber 23 and the skimming chamber 24. As in the embodiment of FIG. 2, the opening 34' is merely disposed near the side wall of the furnace; otherwise, the plate 27' extends down as far as the bottom between the chambers 21′ and 23′. In contrast, the opening 30′ extends over the entire width of the chamber 24′, and, as in the example of FIG. 1, terminates below the surface level of the melt bath. Thus by means of these openings 34′, 30′ the metal melt which is to be kept warm can pass from the filling chamber 21′ into the holding chamber 23′ and from there into the skimming chamber 24′ substantially below the surface of the melting bath.

The holding chamber 23′ is covered by a lid 17′, the inside of which has a depression 43′ in which heating rods 46′ are disposed. If the lid is folded down (FIG. 5) then the heating rods 46′ radiate directly onto the metal melt 20′, which is located in and kept warm in all the chambers, because the size of the holding chamber 23′ in terms of surface area occupies the major portion of the multiple-chamber trough 14′, and the energy thus absorbed from the melt in the holding chamber 23′ suffices to keep the melt warm even in the two other chambers 21′ and 24′. The lid 17′ is attached to the multiple-chamber trough 14′ by a joint schematically indicated at 77. The filling chamber 21′ is covered by a futher lid 16′. The skimming chamber 24′ may be covered by a lid 18′. During operation, as in the exemplary embodiment shown in FIGS. 1 and 2, all the lids are lowered onto the multiple-chamber trough 14′. The process of filling the multiple-chamber trough with a metal melt 20′, preferably an aluminum melt, takes place by way of example via the filling funnel into the filling chamber 21′. From there, all the chambers are then filled. The aluminum melt in the entire multiple-chamber trough 14′ is kept warm by the radiation of heating energy downward on the part of the heating rods 46′. The removal of melt for further use, for instance in a dicasting machine, is effected after the lid 18′ has been removed with the aid of laddle or the like.

In the examplary embodiment as well, the essential feature of the design of the multiple-chamber trough 14′ is its division into a filling chamber, a holding chamber and a skimming chamber, which in the exemplary embodiment are each embodied by one chamber, and which are connected with one another via the passages 34′, 30′ located below the surface of the melt bath. In this exemplary embodiment an additional feature is that the flow path of the non-ferrous metal melt is approximately in the form of a U. In principal, however, these chambers may each be multiple embodiments.

Naturally it is possible to provide more than the three or four chambers shown here. In particular, for instance, more than only a single drain chamber may be provided, in order to be able to supply more than one machine from this furnace.

I claim:

1. A furnace for smelting non-ferrous metals and for holding non-ferrous metal melts, comprising:

a multiple-chamber trough having a bottom and side walls within which at least one-filling chamber, at least one smelting chamber, at least one holding chamber and at least one drain chamber are defined, each chamber having a given length anu given width;

plurality of plate means within said trough serving with said side walls and bottom of said trough to define said at least one filling chamber, said at least one smelting chamber, said at least one holding chamber and said at one drain chamber, such that the filling chamber communicates with the smelting chamber via a first passage, the smelting chamber communicates with the holding chamber via a second passage, the holding chamber communicates with the drain chamber via a third passage, the first, second and third passages are located beneath the surface of the metal melt when in the trough, and the second passage extends over only a portion of the width of the holding chamber and the melting chamber;

at least one first lid covering the smelting chamber and the holding chamber, said at least one first lid including an inner surface of which first heating means are provided for transmitting heat directly to the smelting chamber and second heating means are provided for transmitting heat to the holding chamber;

at least one second lid covering the filling chamber; and at least one third lid covering the drain chamber, wherein said at least one first lid rests on said plurality of plate means to separate, along with said plurality of plate means, said chambers from each other to prevent any communication between said chambers other than through said passages.

2. The furnace as defined in claim 1, further wherein each passage is formed in a respective plate and terminates a certain distance above the bottom of the trough.

3. The furnace as defined in claim 2, further wherein:

the filling chamber has a filling opening and the drain chamber has a drain opening;

the interior area of the trough defined by its bottom and side walls extends in a substantially straight line from the filling opening to the drain opening;

the plate in which the second passage is formed includes spaced apart edges; and the second passage is disposed in a lateral region of the plate within which it is defined adjacent an edge thereof.

4. The furnace as defined in claim 3, further wherein:

the second passage adjoins a side wall of the trough.

5. The furnace as defined in claim 2, further wherein:

the second passage has a cross sectional area substantially smaller than the cross sectional area of the plate within which it is defined.

6. The furnace as defined in claim 5, further wherein:

the cross sectional area of the second passage is approximately 25 to 30 times smaller than the cross sectional area of the plate within which it is defined.

7. The furnace as defined in claim 2, further wherein:

a single lid covers the smelting chamber and the holding chamber;

said first and second heating means includes two groups of electrical heating elements and a dividing panel for separating the two groups; and said dividing panel rests on the upper edge of the plate within which the second passage is defined when the lid covering the smelting chamber and the holding chamber is closed.

* * * * *